United States Patent [19]

Muckenfuhs

[11] Patent Number: 4,966,286

[45] Date of Patent: Oct. 30, 1990

[54] EASY OPEN FLEXIBLE BAG

[75] Inventor: Delmar R. Muckenfuhs, Middletown, Ohio

[73] Assignee: The Procter & Gamble Company, Cincinnati, Ohio

[21] Appl. No.: 371,190

[22] Filed: Jun. 26, 1989

[51] Int. Cl.[5] ..... B65D 30/20; B65D 33/08

[52] U.S. Cl. ..... 206/610; 206/83.5; 206/440; 206/494; 383/10; 383/120

[58] Field of Search ..... 206/610, 620, 440, 494, 206/611, 83.5; 383/10, 21, 120, 66

[56] References Cited

U.S. PATENT DOCUMENTS

| | | | |
|---|---|---|---|
| D. 135,538 | 4/1943 | Kaplan . | |
| 655,998 | 8/1900 | Taylor . | |
| 1,261,612 | 4/1918 | Powers . | |
| 1,733,219 | 10/1929 | Duvall . | |
| 1,920,841 | 8/1933 | Clark | 100/14 |
| 2,011,236 | 8/1935 | Winter et al. | 206/57 |
| 2,127,118 | 8/1938 | Herbelin | 100/14 |
| 2,196,185 | 4/1940 | Belcher | 229/54 |
| 2,349,369 | 5/1944 | Norseen | 206/620 |
| 2,506,021 | 5/1950 | Holmberg | 93/93 |
| 2,700,459 | 1/1955 | Anspacher | 206/46 |
| 2,781,161 | 2/1957 | Adams | 229/54 |
| 2,923,404 | 2/1960 | Adell | 206/610 |
| 3,006,119 | 10/1961 | Fingerhut | 53/24 |
| 3,029,012 | 4/1962 | Leslie | 206/620 |
| 3,044,228 | 7/1962 | Peterson | 53/24 |
| 3,056,245 | 10/1962 | Baum et al. | 53/24 |
| 3,059,387 | 10/1962 | Fasanella | 53/24 |
| 3,117,513 | 1/1964 | Burnett et al. | 100/215 |
| 3,161,336 | 12/1964 | Loescher | 225/106 |
| 3,173,188 | 3/1965 | Wexler | 28/1 |
| 3,206,105 | 9/1965 | Smith | 229/55 |
| 3,327,449 | 6/1967 | Hullhorst et al. | 53/24 |
| 3,339,820 | 9/1967 | Krzyzanowski | 206/620 |
| 3,361,041 | 1/1968 | Grob | 93/8 |
| 3,370,630 | 2/1968 | Haugh et al. | 150/12 |
| 3,381,440 | 5/1968 | Hullhorst | 53/24 |
| 3,514,033 | 5/1970 | Goodwin | 229/54 |
| 3,548,723 | 12/1970 | Sengewald | 93/35 |
| 3,593,622 | 7/1971 | Sengewald | 93/35 |
| 3,605,570 | 9/1971 | Goodwin | 93/35 |
| 3,729,886 | 5/1973 | Lucas et al. | 53/24 |
| 3,818,673 | 6/1974 | Rollins et al. | 53/24 |
| 3,824,759 | 7/1974 | Finn et al. | 53/24 |

(List continued on next page.)

FOREIGN PATENT DOCUMENTS

| | | | |
|---|---|---|---|
| 3629563 | 8/1986 | Fed. Rep. of Germany . | |
| 3642327 | 8/1986 | Fed. Rep. of Germany . | |
| 2035258 | 6/1980 | United Kingdom | 206/610 |

*Primary Examiner*—Stephen P. Garbe

*Attorney, Agent, or Firm*—E. Kelly Linman; John V. Gorman; Richard C. Witte

[57] ABSTRACT

An easy open flexible bag preferably containing one or more stacks of flexible articles which are compressed in a direction substantially parallel to their thickness. The degree of compression may be as much as 50% or more. In a preferred embodiment, the bag encloses the compressed articles and exhibits a substantially rectilinear shape. The bag preferably includes an integral carrying handle. The side, front, and back panels of the bag are subject to tension imposed by the articles. The top of the bag is closed by forming inwardly folded side gussets and sealing the vertically extending portions of the front and back panels to one another. A continuous line of weakness spanning a tensioned side wall of the bag and continuing into the closed uppermost end of the bag is provided. The portion of the line of weakness in the uppermost end of the bag is located near the innermost portions of the opposed inwardly folded side gussets such that the bag may be easily opened by grasping the outermost edge of the top of the bag and partially separating or completely removing the corner of the bag, along with the included side gusset, along the continuous line of weakness. Partial separation or complete removal of a portion of the tensioned side panel of the bag allows the coinciding portion of the stack of compressed articles to project in fan-like array through the aperture to permit easy one-at-a-time removal.

22 Claims, 5 Drawing Sheets

U.S. PATENT DOCUMENTS

| | | | |
|---|---|---|---|
| 4,031,815 | 6/1977 | Verbeke | 93/33 |
| 4,047,362 | 9/1977 | Lister et al. | 53/189 |
| 4,062,169 | 12/1977 | Lister et al. | 53/124 |
| 4,074,508 | 2/1978 | Reid | 53/62 |
| 4,182,237 | 1/1980 | O'Brien | 100/35 |
| 4,216,899 | 8/1980 | Kamp | 229/54 |
| 4,241,562 | 12/1980 | Meyer | 53/438 |
| 4,252,269 | 2/1981 | Peppiatt | 229/54 |
| 4,328,655 | 5/1982 | Spencer et al. | 53/439 |
| 4,414,788 | 11/1983 | Berg | 53/436 |
| 4,501,107 | 2/1985 | Piotrowski | 53/438 |
| 4,539,705 | 9/1985 | Baines | 383/8 |
| 4,550,439 | 10/1985 | Peppiatt et al. | 383/8 |
| 4,557,385 | 12/1985 | Robinson | 206/620 |
| 4,573,203 | 2/1986 | Peppiatt | 383/8 |
| 4,577,453 | 3/1986 | Hofeler | 53/438 |
| 4,602,472 | 7/1986 | Ampolini et al. | 53/438 |
| 4,604,084 | 8/1986 | Pistner | 493/226 |
| 4,605,392 | 8/1986 | Achelpohl et al. | 493/196 |
| 4,607,388 | 8/1986 | Koiyumaki et al. | 383/121 |
| 4,608,808 | 9/1986 | Ryan et al. | 53/436 |
| 4,609,366 | 9/1986 | Ley et al. | 493/22 |
| 4,610,029 | 9/1986 | Huhtala et al. | 383/10 |
| 4,613,988 | 9/1986 | Maddock | 383/8 |
| 4,628,535 | 12/1986 | Tetenborg | 383/24 |
| 4,633,649 | 1/1987 | Gautier et al. | 53/413 |
| 4,636,191 | 1/1987 | Piggott | 493/227 |
| 4,638,913 | 1/1987 | Howe, Jr. | 206/632 |
| 4,660,352 | 4/1987 | Deines et al. | 53/438 |
| 4,660,354 | 4/1987 | Lancaster et al. | 53/469 |
| 4,661,989 | 4/1987 | Risby | 383/2 |
| 4,664,957 | 5/1987 | van de Pol | 428/35 |
| 4,677,810 | 7/1987 | Spano | 53/428 |
| 4,685,276 | 8/1987 | Kiel | 53/459 |
| 4,686,815 | 8/1987 | Zils et al. | 53/469 |
| 4,688,369 | 8/1987 | Cornish et al. | 53/436 |
| 4,688,370 | 8/1987 | Dighton et al. | 53/469 |
| 4,688,372 | 8/1987 | Langen et al. | 53/529 |
| 4,691,369 | 9/1987 | Costa | 383/17 |
| 4,694,638 | 9/1987 | Maddux, Jr. et al. | 53/459 |
| 4,696,050 | 9/1987 | Sengewald | 383/10 |
| 4,696,145 | 9/1987 | Schmidt et al. | 53/436 |
| 4,699,608 | 10/1987 | Pistner | 493/204 |
| 4,702,731 | 10/1987 | Lambrecht et al. | 493/196 |
| 4,703,517 | 10/1987 | Marino | 383/7 |
| 4,704,100 | 11/1987 | Kaufman | 493/194 |
| 4,706,440 | 11/1987 | Bittner | 53/438 |
| 4,710,967 | 12/1987 | Petschner | 383/8 |
| 4,711,066 | 12/1987 | Fox et al. | 53/436 |
| 4,713,839 | 12/1987 | Peppiatt | 383/29 |
| 4,715,635 | 12/1987 | Koskinen | 294/68.1 |
| 4,717,262 | 1/1988 | Roen et al. | 383/120 |
| 4,720,872 | 1/1988 | Kaczerwaski | 383/8 |
| 4,721,396 | 1/1988 | Sengewald | 383/8 |
| 4,730,942 | 3/1988 | Fulcher | 383/7 |
| 4,730,943 | 3/1988 | Johnson | 383/8 |
| 4,738,546 | 4/1988 | Sengewald | 383/120 |
| 4,846,587 | 7/1989 | Hull | 383/10 |

EASY OPEN FLEXIBLE BAG

TECHNICAL FIELD

The present invention relates to an easy open flexible bag filled with a multiplicity of articles which are normally used one at a time.

The present invention further relates, in a particularly preferred embodiment, to such an easy open bag wherein the articles contained therein are comprised of compressible material, such as disposable absorbent bandages, baby diapers, sanitary napkins, incontinent briefs and the like.

The present invention further relates to such an easy open bag wherein the articles in question are compressed in a direction perpendicular to their thickness and wherein said bag maintains said articles in a state of compression until activation of the easy open feature.

The present invention further relates to such an easy open flexible bag which, upon activation of the easy open feature, will permit the compressed articles to partially expand from the inner confines of the bag to produce a fan like array of articles to permit easy one-at-a-time removal of the articles from the bag.

The present invention further relates to such an easy open flexible bag wherein the compressed articles tend to automatically feed into the aperture formed in the bag by activation of the easy open feature, at least until such time as the articles remaining within the bag return to their initially uncompressed thickness.

The present invention further relates to such an easy open flexible bag which can be constructed of relatively low cost flexible materials such as polymeric films, papers, nonwovens, or laminate structures comprised of two or more such low cost materials.

BACKGROUND ART

Relatively soft and flexible compressible articles such as disposable diapers, catamenial pads, incontinent briefs and the like have entered widespread use in many parts of the world over the last 20–30 years. Many of these products are produced as continuous webs which are typically folded one or more times parallel to the direction of web travel as they travel through the converting lines in the machine direction and are ultimately cut from the web to form discrete single use articles. The discrete articles are typically folded at their midpoint, collected in stacks and inserted into paperboard or cardboard cartons or flexible bags while they are subject to little or no compression in a direction substantially parallel to their thickness.

In such circumstance, the dimensions of the paperboard or cardboard carton or flexible bag are generally determined by the number of discrete articles contained in the stack or stacks placed within the carton or bag.

Recent consumer purchasing trends in the disposable absorbent products field, particularly in the United States, have led to lower purchase frequencies with larger quantities of disposable absorbent products per purchase. Manufacturers have responded by continuing to increase the number of discrete articles contained within a single package, resulting in a number of jumbo packs containing relatively large quantities of disposable absorbent products such as baby diapers, e.g., 32, 44, 48, 64, 96, etc. Because of the bulk of the relatively low density flexible compressible articles in question, this has resulted in packages having high volume but low weight. This combination of high volume and low weight increases storage and handling costs for the manufacturer, rapidly exhausts the limited shelf space of the retailer, and detracts from the convenience of storage and use for the consumer.

In addition, the relatively large volume of package material required to house the disposable absorbent articles in an uncompressed condition must be disposed of when the package in question has been fully emptied. In the case of cartons, this requires further effort by the end user to crush or otherwise minimize the volume of the empty container before placing it in the trash.

OBJECTS OF THE INVENTION

Accordingly, it is an object of the present invention to overcome or at least reduce the severity of the aforementioned storage, handling and disposability problems associated with prior art packages of substantially uncompressed flexible articles, while simultaneously providing improved convenience for and acceptance by the end user.

It is another object of the present invention to provide an easy open flexible package of compressed flexible articles which can simultaneously overcome many of the problems of the prior art packages of substantially uncompressed articles, as described in the preceding paragraphs, while simultaneously reducing the costs incurred by the manufacturer.

It is another object of the present invention to provide an easy open flexible bag filled with one or more stacks of compressed flexible articles, which bag can be comprised of relatively inexpensive materials such as polymeric films, papers, nonwovens, or a laminate comprising two or more of such materials, thereby decreasing the severity of the disposal problem from an environmental standpoint both with respect to the amount of packaging material required and the disposability/degradability of the particular bag material selected.

It is another object of the present invention to provide an easy open flexible bag of compressed flexible articles which exhibits an unobstructed opening feature which can readily be found by the end user and which can be easily and reliably opened by gripping with the user's fingers and tearing along a predetermined line of weakness in the bag material.

It is another object of the present invention to provide such an easy open flexible bag filled with compressed flexible articles which, upon activation of the easy open feature, will cause the unrestrained portion of the compressed articles housed within the bag to partially project in a fan-like arrangement through the aperture created in the tensioned side panel of the bag. This permits easy one-at-a-time removal of discrete articles from the bag, at least until such time as the compressive forces acting upon the articles remaining in the bag have been substantially relieved.

It is still another object of the present invention to provide an easy open flexible bag which will offer improved convenience in opening and improved access to the bag's contents even when employed in situations where the articles contained within the bag are not subject to any appreciable compression.

DISCLOSURE OF THE INVENTION

The present invention, in a particularly preferred embodiment, comprises an easy open side gusseted flexible bag containing one or more stacks of flexible articles maintained in a state of compression in a direction substantially parallel to their thickness. For products such as disposable absorbent baby diapers, catamenial pads, incontinent briefs and the like, the degree of compression within the bag may be as much as 50% or more when compared to the uncompressed thickness of the stack of articles in question.

In a particularly preferred embodiment, the side gusseted bag totally encloses the stack or stacks of compressed flexible articles and exhibits a substantially rectilinear shape. The flexible bag preferably comprises a front panel and a back panel connected to one another by means of a pair of side panels. A bottom panel is secured about its periphery to the lowermost edges of the front and back panels and the side panels. At least one stack of compressed articles oriented so that their substantially planar surfaces are aligned substantially parallel to the side panels of the bag while the exposed peripheral edges of the articles contained within the stack are aligned substantially parallel to the front, back and bottom panels of the bag is preferably totally enclosed within the bag by forming gussets in the side panels and sealing the uppermost ends of the front and back panels of the bag, including the inwardly folded side gussets, to one another. The side panels and the front and back panels are preferably subject to tension imposed by the stack of compressed flexible articles.

The sealed uppermost end of the bag, including the inwardly folded and secured side gussets, also includes an easily visible, unobstructed easy open device which may be activated by gripping between the user's fingers and pulling to create an unobstructed aperture traversing at least one corner of the bag.

The easy opening device employed in a particularly preferred embodiment of the present invention comprises a substantially continuous line of weakness traversing a portion of one of the side panels of the bag and extending into the top portion of the bag intermediate the opposed inwardly folded side gussets of the bag. The line of weakness can be formed by many means well known in the art, including, for example only, perforations in the bag material. The portion of the line of weakness contained within the side panel in question exhibits a shape approximating up to about 75% of the cross-sectional shape of a given stack of articles contained within the bag. In the case where stacks of articles are superposed on one another, an ancillary line or lines of weakness are preferably provided in order to permit further extending the aperture down the side panel as the initial stack of articles is exhausted.

In a particularly preferred embodiment of the present invention, the uppermost end of the bag is folded into a side gusseted arrangement and initially secured to itself immediately adjacent the uppermost surface of the articles contained within the bag. The bag is preferably secured to itself again a predetermined distance above the initial seal. A curvilinear slit or aperture which will permit insertion of the user's fingers for carrying the bag is preferably provided intermediate the two substantially horizontal areas of securement in the uppermost end panel.

In a particularly preferred embodiment, the portion of the continuous line of weakness in the uppermost end of the bag converges from the corners of the package adjacent the side panel containing the balance of the line of weakness to the initial centrally located area of securement formed at the uppermost end of the bag. It thereafter proceeds in a substantially vertical orientation to the second area of securement and ultimately to the uppermost edge of the bag. To facilitate easy opening and removal of the entire corner of the bag, including the inwardly folded side gusset, the vertically extending portions of the line of weakness are most preferably positioned somewhere in between the two opposed, inwardly folded side gussets. If only a small corner portion of the bag is to be removed, the vertically extending portions of the line of weakness most preferably lie between the side gusset adjacent the side panel containing the balance of the line of weakness and the slit or aperture employed for carrying the bag. In this instance, opening the bag by tearing along the line of weakness either partially separates or completely removes essentially the entire corner of the bag, including the side gusset, but leaves the slit or aperture comprising the handle intact.

If a larger opening is desired, the line of weakness can extend from the side panel containing the balance of the line of weakness all the way to the area between the slit or aperture for the user's fingers and the opposite side gusset. Opening a bag defined by such a line of weakness either partially separates or completely removes a substantially greater portion of the top of the bag, including the slit or aperture comprising the handle, along with the predetermined portion of the side panel defined by the balance of the line of weakness.

If desired, flexible bags of the present invention may be provided with double lines of weakness so that the user may choose to separate or remove only a corner of the bag, leaving the carrying means intact, or a substantially greater portion of the top including the carrying means.

BRIEF DESCRIPTION OF THE DRAWINGS

While the specification concludes with claims particularly pointing out and distinctly claiming the present invention, it is believed the present invention will be better understood from the foregoing description in conjunction with the accompanying drawings in which:

DETAILED DESCRIPTION OF THE INVENTION

While the present invention will be described in the context of providing an easy open flexible bag containing one or more stacks of folded disposable absorbent diapers, the present invention is in no way limited to such application. Furthermore, while the illustrated embodiments of the invention disclose folded disposable diapers which are maintained in a state of compression in a direction substantially parallel to their thickness, many of the benefits of the easy open feature of the present invention may also be provided in packages wherein the objects contained therein are not subject to compressive forces. Thus, it is not a requirement of the present invention that the articles contained within the flexible bag be held in a state of compression by the bag prior to opening.

As pointed out earlier herein, the present invention may be practiced to greatest advantage to provide reduced storage, shipping and handling costs in any situation involving flexible articles which are substantially compressible in at least one of their dimensions, such as their thickness. In addition, the present invention can be practiced to great advantage to provide automatically assisted dispensing of discrete flexible articles one at a time due to the action of the compressive forces acting upon the flexible articles during a substantial portion of the bag's usable life. The detailed description contained herein, which relates to a particularly preferred easy open flexible bag of compressed disposable diapers, will allow one skilled in the art to readily adapt the invention to other uses.

Figure 1:
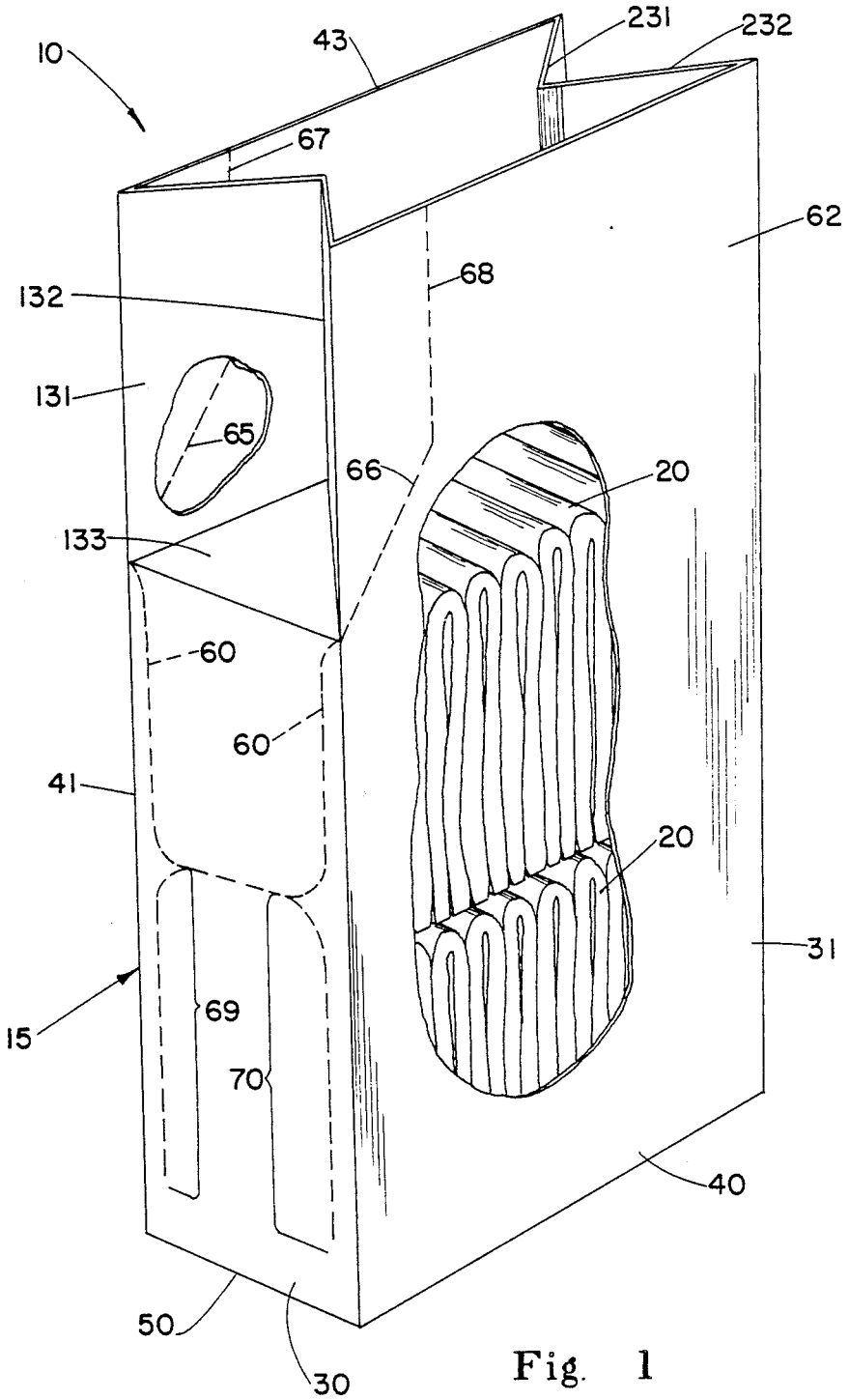
FIG. 1 is a simplified perspective view of a particularly preferred easy open flexible bag of compressed flexible articles of the present invention, said view being taken before the side gussets formed at the top of the bag have been secured in position.

FIG. 1 is a simplified perspective illustration of a particularly preferred embodiment 10 of an easy open flexible bag of compressed flexible articles 20 of the present invention. The compressed articles 20 may comprise disposable absorbent diapers such as those disclosed in commonly assigned U.S. Pat. No. 3,860,003 issued to Buell on Jan. 14, 1975 and hereby incorporated herein by reference. Prior to stacking and insertion into the bag, the diapers 20 are typically folded one or more times in a direction generally parallel to the machine direction during converting so that the ears of each hourglass shaped diaper overlie the central portion of the diaper. The diapers 20 are also preferably folded about their midpoints after being cut from a continuous web and prior to being collected into stacks. The resultant cross-section of each stack of diapers 20 is substantially rectangular. In the embodiment shown in FIG. 1, two such stacks are provided so that the side panels 30 and 31 of the flexible bag 15 are substantially equal to the cross-section of two stacks of diapers 20.

Prior to insertion into the bag 15, the stacks of folded disposable diapers 20 are subjected to compression to reduce the overall dimension of the stack by as much as 50% or more relative to the uncompressed height of the stack.

As can be seen from FIG. 1, the stacks of compressed diapers 20 are maintained in their compressed state by opposing side panels 30 and 31 which are joined to front panel 40, back panel 41 and bottom panel 50.

Flexible bag 15 illustrated in FIG. 1 is preferably formed into a continuous tube having an axis parallel to the height of the bag and the top and bottom portions of the bag are closed by forming side gussets.

In FIG. 1, the bottom 50 of the bag is shown in its folded and secured position. FIG. 1 illustrates the top of the bag prior to final folding and sealing. In the condition shown in FIG. 1, the portion of the front panel of the bag extending above the uppermost stack of diapers 20 is designated 42 and the portion of the back panel extending above the uppermost stack of disposable diapers 20 is designated 43. Front and back panel portions 42 and 43 are substantially planar in the condition illustrated in FIG. 1. By way of contrast, the portions of side panel 30 extending above the uppermost stack of disposable diapers 20 are inwardly folded into a gusset comprising panels 131, 132 and 133. A similarly inwardly folded gusset is formed at the opposite side panel 31. The opposite gusset comprises panels 231, 232 and 233 (the mirror image of panel 133 which is not shown).

In the illustrated embodiment of FIG. 1, the tension required to keep the disposable absorbent diapers 20 in a compressed state is carried by side panels 30 and 31 and front and back panels 40 and 41. Bottom panel 50 and the vertical extensions 131, 132, 133 and 231, 232, 233 of side panels 30 and 31, respectively, and the vertical extensions 42 and 43 of front and back panels 40 and 41, respectively, are in a substantially untensioned condition.

The easy open feature of flexible bag 15 comprises a substantially continuous line of weakness which traverses side panel 30 in an area generally coinciding with the uppermost portion of the uppermost stack of disposable diapers 20 and extends into the vertically extending portions 42 and 43 of the front and back panels 40 and 41, respectively, of the bag. In the embodiment illustrated in FIG. 1, the substantially continuous line of weakness comprises line of perforation 60 in side panel 30, the uppermost ends of which substantially connect with lines of perforation 65, 67 and 66, 68 in the back and front panel extensions 43 and 42, respectively, of the back and front panels 41 and 40, respectively, of bag 15. Because portions 65, 67 and 66, 68 of the continuous line of weakness are located in substantially untensioned panels, this portion of the line of weakness may be designed to rupture at relatively low levels of applied force. Conversely, because side panel 30 is, at least in a particularly preferred embodiment of the present invention, subject to tension, the perforations or other form of weakening employed to create the line of weakness are preferably more resistant to tearing. This minimizes the chance of premature opening of the bag due to the tensile forces imposed by the compressed articles 20 contained within the bag.

Since the bag of compressed flexible articles 10 illustrated in FIG. 1 includes two stacks of disposable diapers 20, the portion of the continuous line of weakness 60 located in side panel 30 is intended to expose only a portion of the uppermost vertical stack of diapers. When the uppermost stack of diapers has been exhausted, ancillary lines of perforation 69 and 70 are preferably provided in the lowermost portion of side panel 30 to facilitate creation of a similar access opening for the lowermost stack of disposable diapers contained within the bag.

Figure 2:
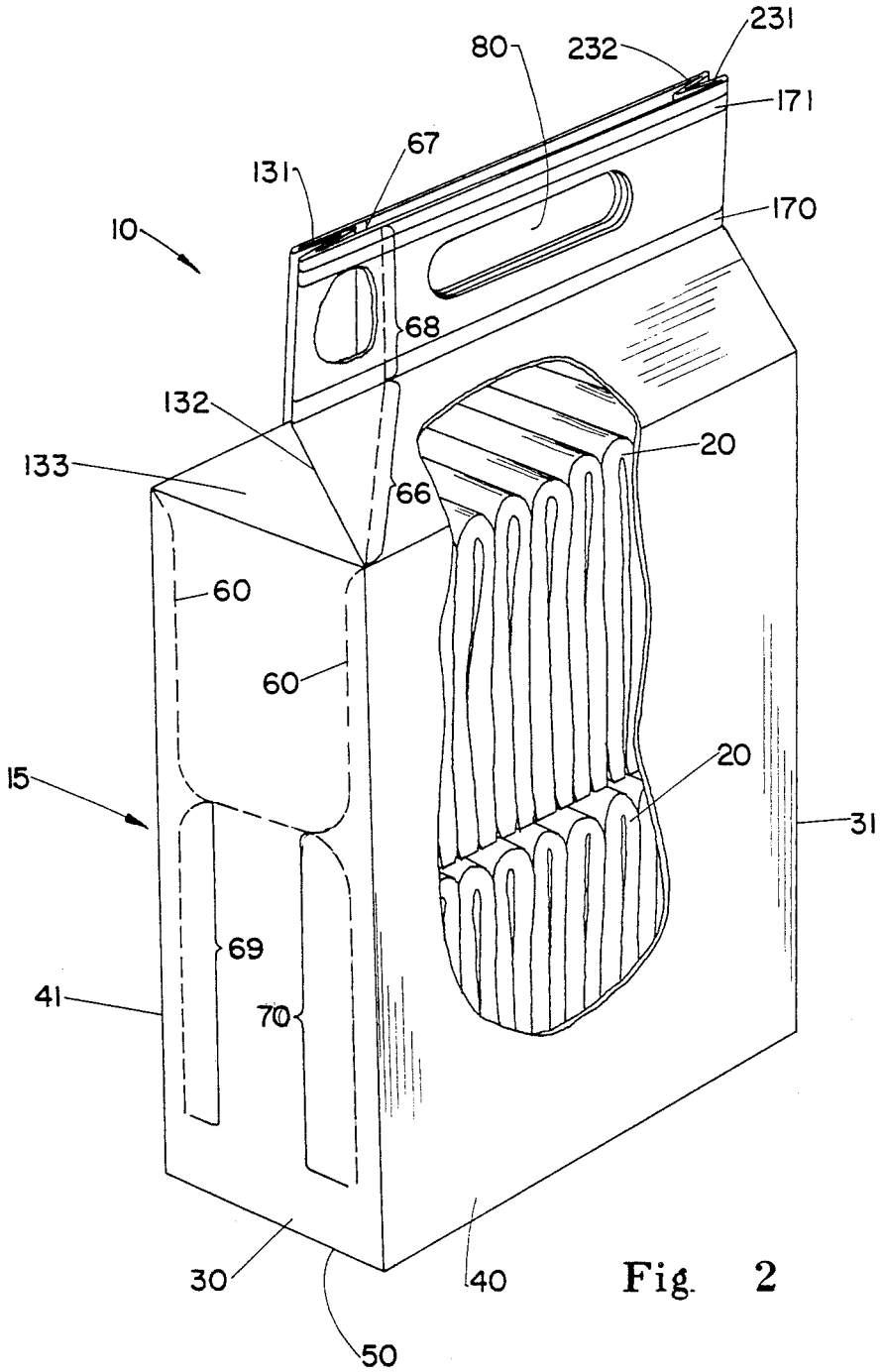
FIG. 2 is a similar simplified perspective view of the bag of FIG. 1, but showing the conditions which exist after the side gusseted uppermost end of the bag has been closed and secured and an aperture for the user's fingers has been cut in the vertical extensions of the front and back walls of the bag.

FIG. 2 illustrates the particularly preferred embodiment 10 of the present invention illustrated in FIG. 1 after the side gussets comprising panels 133 and 231, 232, 233 (not shown) have been folded flat and a pair of substantially horizontal areas of securement 170, 171 have been created to close off the top end of the bag. In addition, a slit or aperture 80 has been provided in the upwardly extending portions of the bag located intermediate the horizontal areas of securement 170, 171.

The particular means used to establish the areas of securement 170, 171 is noncritical, e.g., heat seal, adhesive, etc.

As can be seen in FIG. 2, lines of perforation 67, 68 which extend in a generally vertical direction are substantially aligned with one another and are most preferably located inboard of the innermost portion of the inwardly folded side gusset formed by panels 131, 132 and 133. Lines of perforation 65 (shown only in FIG. 1) and 66 substantially connect vertically oriented lines of perforation 67, 68 with the upwardly extending end points of line of perforations 60 in side panel 30. Because the vertically extending lines of perforation 67, 68 are located inboard of the innermost portion of the side gusset formed by panels 131, 132, and 133, the bag 15 can readily be opened without the need to tear any of the side gusset material by grasping the outermost edge of the top of the bag and applying tension thereto. This causes the uppermost corner of the bag, including the entire inwardly folded side gusset, to rupture along lines of perforation 67, 68, 65, 66 and 60 to produce complete removal of a corner of the bag, as generally illustrated in FIG. 2A.

As will be appreciated, the use of inwardly folded side gussets and the vertically extending panel extensions at the top of bag 15 to provide a carrying handle comprising aperture 80 is highly desirable. It provides carrying convenience and helps the end user to easily determine how to initiate the bag opening and dispensing cycle. If desired, the upwardly extending lines of perforation 67, 68 can be readily identified by graphical symbols, colored indicia, contrasting colors on opposite sides of the perforations, etc.

Figure 2A:
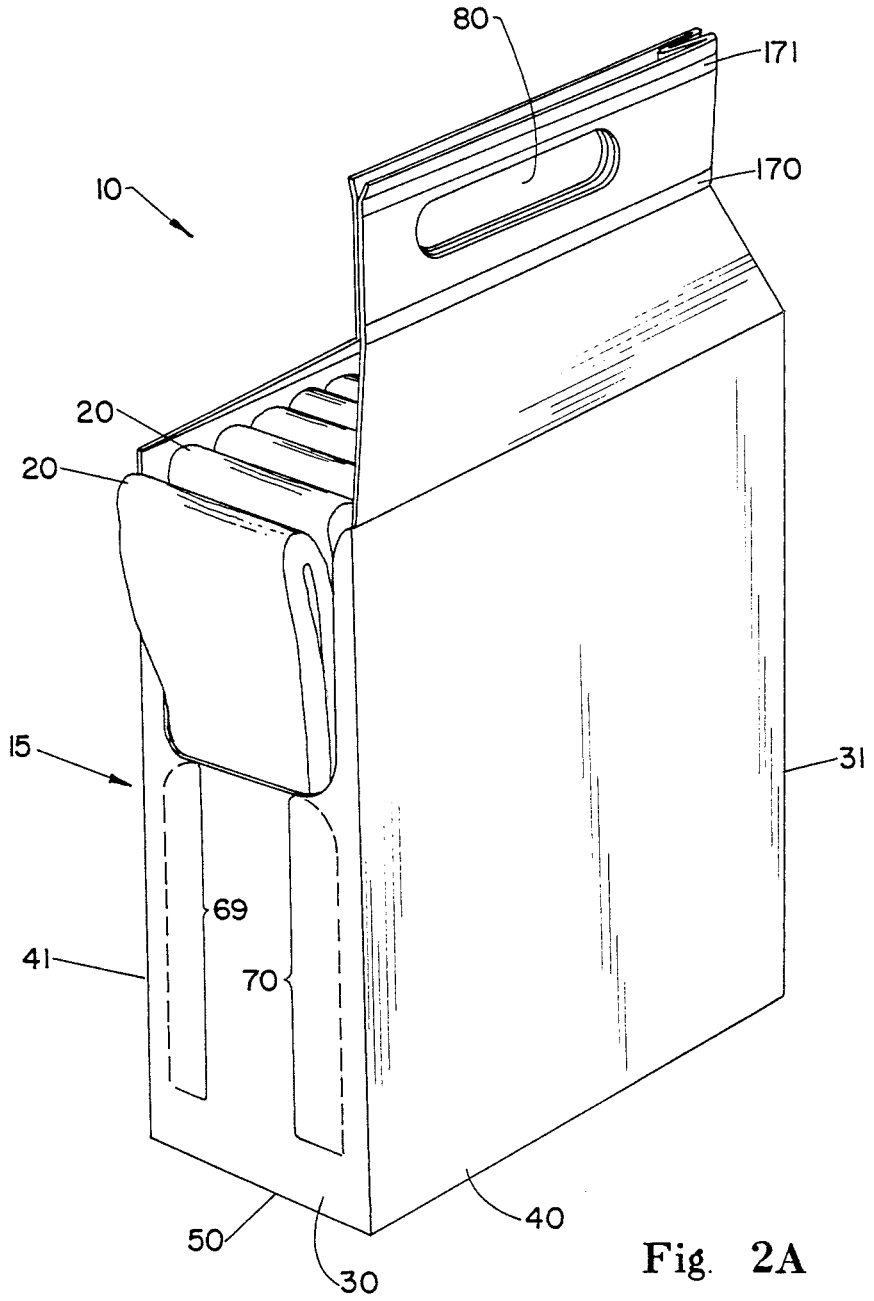
FIG. 2A is a view of the bag illustrated in FIG. 2 after the easy opening device has been activated by the end user.

As can best be seen from FIG. 2A, the unrestrained folded edges of the compressed disposable diapers 20 begin to project through the aperture spanning the tensioned side panel 30 in a fan-like array. This is due to a partial release of the compressive forces acting upon the uppermost portion of the uppermost stack of compressed disposable diapers contained within the flexible bag 15.

As will be appreciated by those skilled in the art, it is necessary to retain at least a portion of the cross sectional shape of the stack of folded compressed diapers 20 subject to compression in order to produce the automatic fan-like array illustrated in FIG. 2A. While FIGS. 2 and 2A depict removal of about 60% of the height of the uppermost stack of diapers, laving about 40% of the depth of the stack of diapers subject to compressive restraint, it has been determined that easy open flexible bags of the present invention can employ apertures spanning up to about 75% of the vertical depth of the compressed stack of products while still maintaining control of the lowermost portion of the stack.

As will also be apparent from FIG. 2A, removal of the portion of side panel 30 defined by line of perforations 60 leaves ancillary lines of perforation 69 and 70 undisturbed. Thus, the entire lowermost stack of disposable diapers 20 is maintained under compression until the uppermost stack of diapers has been exhausted and the user intentionally ruptures lines of perforation 69, 70 to similarly expose the lowermost stack of diapers in a fan-like array.

In general, it has been observed that it is preferable to provide the portion of line of weakness 60 contained within the tensioned side panel 30 with a shape which converges slightly from its intersection with the top corners of the bag to assist in providing better overall retention of the stack of compressed articles 20 within the bag without impeding the ability of the uppermost portion of the articles 20 to automatically project in fan-like array through the uppermost portion of the aperture formed in the tensioned side panel 30. This restraining action might be likened to the use of a pair of suspenders to hold up the waistband of a pair of trousers on a person having a rotund midsection, i.e., the rotund midsection projects forwardly between the suspenders.

A similarly shaped aperture may be provided in the lowermost portion of side panel 30 by lines of perforation 69 and 70. The lines of perforation 69 and 70 may also, if desired, be interconnected to one another at the bottom so that the portion of side panel 30 lying intermediate lines of perforation 69, 70 may be removed rather than left hingedly connected, as would be the case for the flexible bag of compressed disposable diapers comprising embodiment generally illustrated in FIG. 2A. In this regard it will be appreciated that the corner of the bag which is initially opened may also, as an alternative to complete removal, be left hingedly connected along the substantially horizontal portion of line of perforations 60. In the latter case, the horizontal portion of the line of perforations 60 may even be deleted.

The tendency of the compressed disposable diapers 20 to project through the aperture formed in the uppermost portion of the tensioned side wall 30 of bag 15 will continue throughout a substantial portion of the dispensing cycle of the bag. It will in general be present until such time as the articles remaining within the bag are substantially returned to their substantially uncompressed thickness. However, even when this condition has been reached, removal of the remaining articles is still relatively easy for the end user due to the product exposure provided by removal of the corner of the bag.

Figure 3:
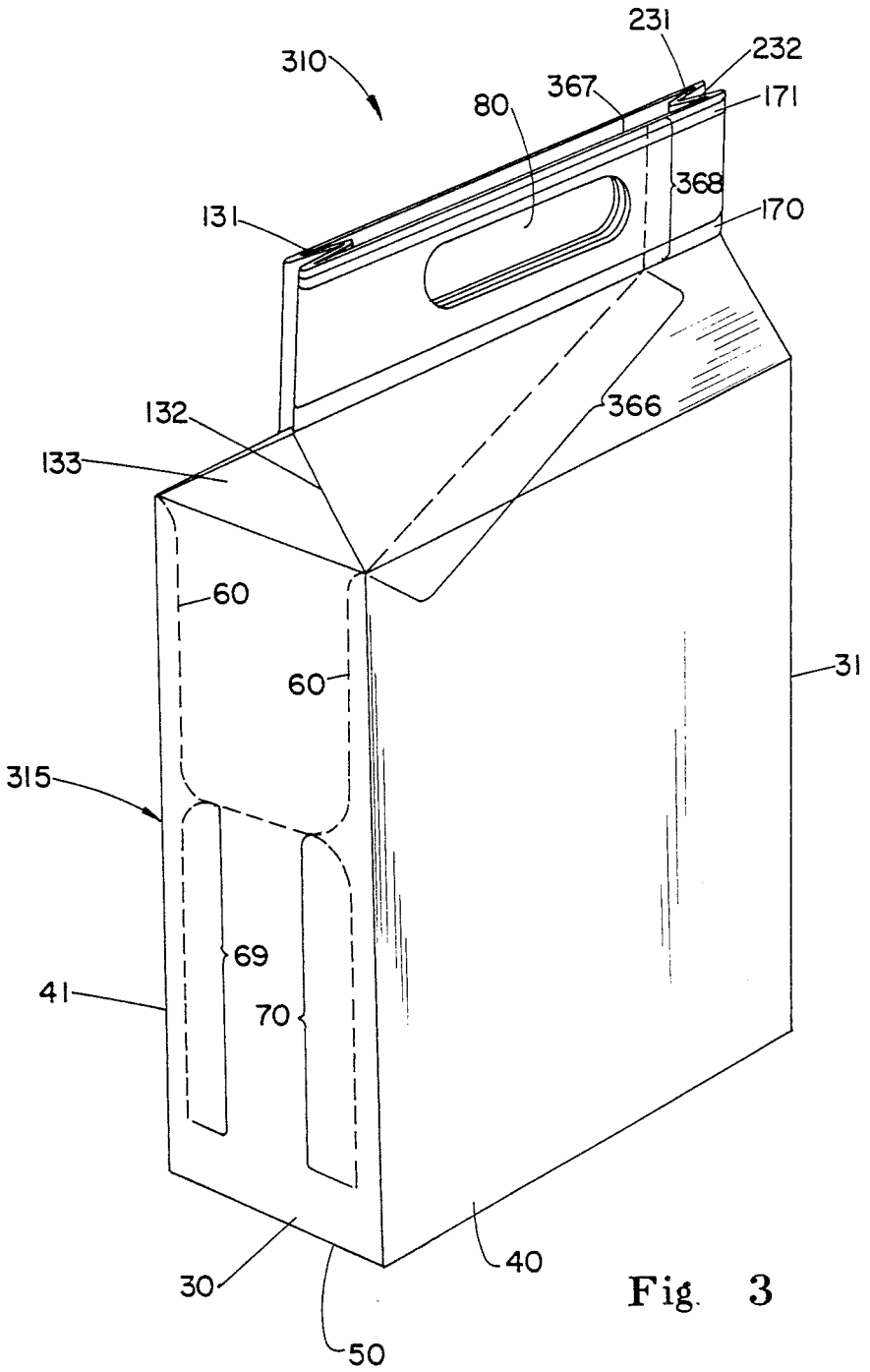
FIG. 3 is a view of an alternative flexible bag of compressed flexible articles of the present invention illustrating an easy open device for removing a substantially greater portion of the top of the bag, including the carrying means, along with a predetermined portion of the side panel of the bag, said view being taken before activation of the easy open feature.
Figure 3A:
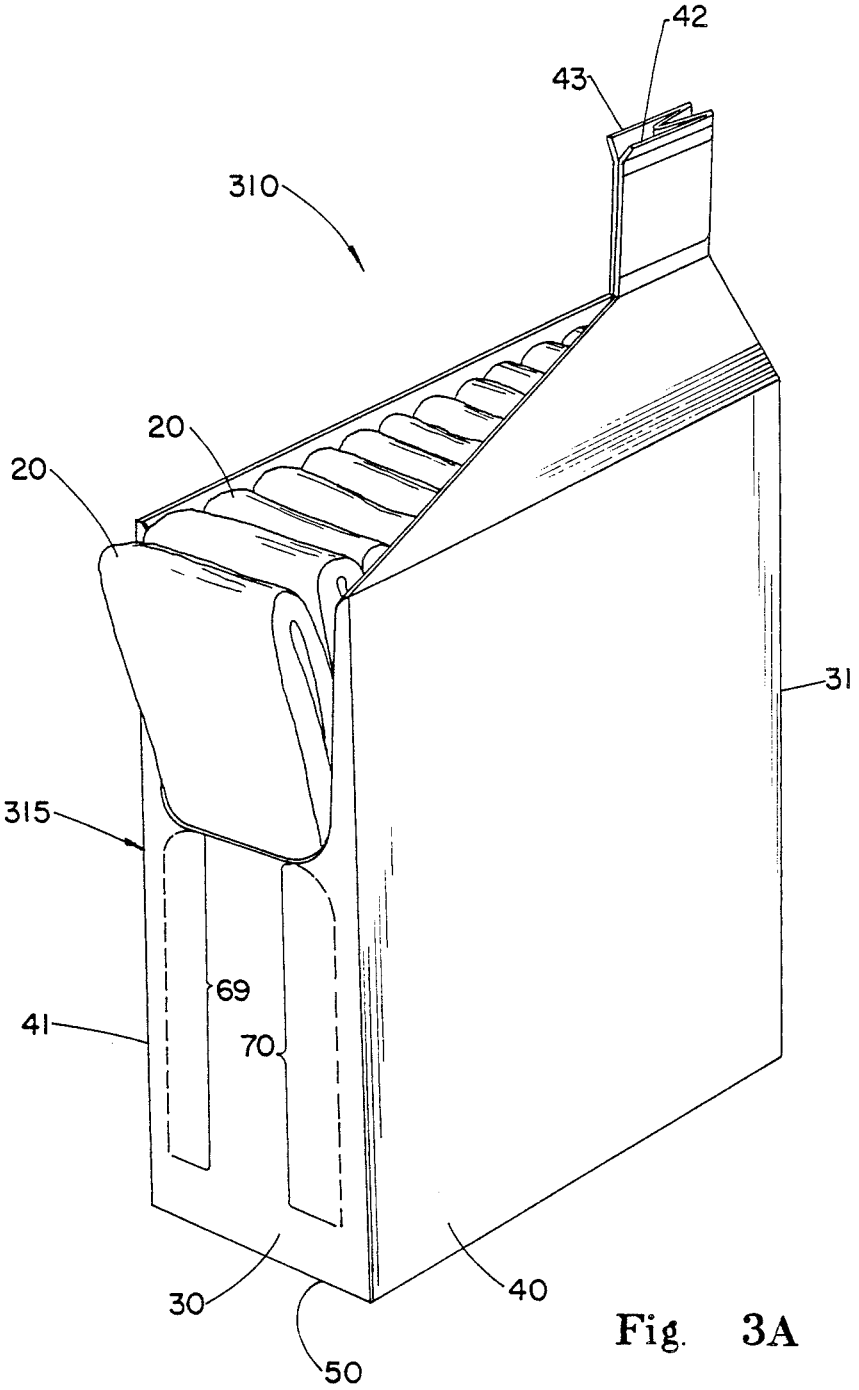
FIG. 3A is a view of the bag generally shown in FIG. 3 after the easy open feature has been activated and the portion of the bag defined by the line of weakness removed from the remainder of the bag.

FIG. 3 discloses an alternative embodiment 310 of an easy open flexible bag containing two stacks of flexible articles maintained in a state of compression in a direction substantially parallel to their thickness. Embodiment 310 is identical to embodiment 10 with the exception that the continuous line of weakness has been altered to provide greater exposure of the top of the bag upon activation of the easy open feature. In particular, lines of perforation 65, 67 and 66, 68 have been replaced by lines of perforation 365 (not shown), 367 and 366, 368. By increasing the length of lines of perforation 365 and 366, the substantially vertically oriented lines of perforation 367, 368 are now located between aperture 80 and the opposite side gusset formed by panels 231, 232, 233 (not shown). When the bag 315 is opened, the entire handle portion and a much larger portion of the top of the bag is exposed, as generally shown in FIG. 3A. In all other respects, opening of bag embodiment 310 is essentially the same as opening of bag embodiment 10 shown in FIG. 1.

As will be appreciated by those skilled in the art, flexible bags of the present invention could be provided with lines of perforation 65, 67 and 66, 68 in addition to lines of perforation 365 (not shown), 367 and 366, 368. This would allow the end user to select whether to remove a small corner portion of the bag or a much larger corner portion of the bag including substantially the entire top panel when placing the bag in service.

As will be appreciated, the lines of perforation comprising the line of weakness may be produced while the bag material is flat, i.e., prior to complete assembly of the bag or after assembly of the bag. Regardless of how the lines of weakness are formed, it is generally preferable that the vertically extending lines of perforation 67, 68 and/or 367, 368 be located near the innermost projections of the opposed inwardly folded side gussets, most preferably slightly inboard of the innermost projections of the opposed inwardly folded side gussets. Placing vertically extending lines of perforation 67, 68 and/or 367, 368 inboard of the innermost projections of the opposed inwardly folded side gussets ensures trouble free separation of the entire side gusset from the closed uppermost end of the bag when the easy open device is activated, since no tearing of the side gusset material is required in this embodiment of the present invention.

If the vertically extending lines of perforation overlap one of the inwardly folded side gussets, some tearing of the material comprising the side gusset must occur to separate the uppermost corner of the bag along the continuous line of weakness. In this instance it is generally preferable that the underlying portions of the side gusset also include some form of a line or lines of weakening generally coinciding with the vertically extending lines of perforation 67, 68 and/or 367, 368 to ensure easy separation of the corner of the bag from its closed uppermost end. In embodiments of the aforementioned type, the closer the vertically extending lines of perforation 67, 68 and/or 367, 368 are to the innermost end of the side gusset, the easier will be the separation of the corner of the bag along the continuous line of weakness, since less tearing of the side gusset material will be required.

It is also recognized, that if the line of weakness is comprised of perforations, the nature of the perforations may be altered from straight vertical slits along a common axis to offset, zippertooth or other types of patterns of perforations where precise alignment of the lines of perforation 67, 68 and/or 367, 368 is made less critical. Perforations exhibiting a degree of lateral extension may be particularly desirable where the bag is finally erected after perforating, since this minimizes the need for precise registration of the lines of perforation 67, 68 and/or 367, 368 in the opposing front and back panel extensions with one another.

While the present invention has been described in the context of an easy open flexible bag containing flexible compressed disposable diapers, it is recognized that the present invention may also be practiced to advantage in many other applications and environments. Specifically, it is recognized that the easy open feature of the present invention may be practiced on flexible bags of articles which are not subject to compression within the bag prior to opening. It will be obvious to those skilled in the art that various changes and modifications can be made without departing from the spirit and scope of the present invention, and it is intended to cover in the appended claims all such modifications that are within the scope of this invention.

What is claimed is:

1. An easy open substantially rectangular flexible bag of articles, said articles being arranged in a stack in a direction substantially parallel to their thickness, said bag of articles comprising:

(a) a flexible bag having a front and a back panel connected to one another by means of a pair of side panels, a bottom panel secured about its periphery to said front and back and side panels and a closed uppermost end comprising a pair of inwardly folded side gussets secured between the vertically extending portions of said front and back panels by means of at least one horizontal area of securement;

(b) a stack of articles contained within said flexible bag, said articles being oriented so that the substantially planar surface of said articles is aligned substantially parallel to the side panels of said bag and the outermost peripheral edges of the articles contained within said stack are aligned substantially parallel to the front and back panels of said bag; and (c) an easy open device comprising a substantially continuous line of weakness located partially within one of said side panels of said bag and extending into said closed uppermost end of said bag near an innermost end of one of said opposed, inwardly folded side gussets, whereby said easy open bag can be easily opened by at least partially separating a corner portion of said bag from the remainder of said bag by applying tension along said continuous line of weakness, said separation also removing the included portion of said side gusset from the closed uppermost end of said bag during the separation process.

2. An easy open substantially rectangular flexible bag of articles, said articles being arranged in a stack in a direction substantially parallel to their thickness, said bag of articles comprising:

(a) a flexible bag having a front and a back panel connected to one another by means of a pair of side panels, a bottom panel secured about its periphery to said front and back and side panels and a closed uppermost end comprising a pair of inwardly folded side gussets secured between the vertically extending portions of said front and back panels by means of at least one horizontal area of securement;

(b) a stack of articles contained within said flexible bag, said articles being oriented so that the substantially planar surface of said articles is aligned substantially parallel to the side panels of said bag and the outermost peripheral edges of the articles contained within said stack are aligned substantially parallel to the front and back panels of said bag; and (c) an easy open device comprising a substantially continuous line of weakness located partially within one of said side panels of said bag and extending into said closed uppermost end of said bag inboard of said opposed, inwardly folded side gussets, whereby said easy open bag can be easily opened by at least partially separating a corner portion of said bag from the remainder of said bag by applying tension along said continuous line of weakness, said separation also removing said included side gusset portion of said bag from the closed uppermost end of said bag during the separation process.

3. The flexible bag of articles of claim 1 or claim 2, wherein a pair of horizontal areas of securement are provided in the uppermost end of said bag, said horizontal areas of securement being separated from one another by a predetermined distance, said bag further including means for carrying said bag provided in the area located intermediate said horizontal areas of securement.

4. The flexible bag of claim 3, wherein said means for carrying said bag comprises a continuous curvilinear slit.

5. The flexible bag of claim 4, wherein said continuous curvilinear slit defines an aperture.

6. The flexible bag of claim 3, wherein said portion of said line of weakness extending into said closed uppermost end of said bag is located between said carrying means and the innermost end of the side gusset located adjacent said side panel containing a portion of said line of weakness.

7. The flexible bag of claim 3, wherein said portion of said line of weakness located in said closed uppermost end of said bag is located between said carrying means and the innermost end of the side gusset located opposite said side panel containing a portion of said line of weakness.

8. The flexible bag of claim 3, wherein at least two superposed stacks of articles are contained within said flexible bag, and wherein said side panel containing a portion of said line of weakness further includes a pair of ancillary lines of weakness to expose a portion of a secondary stack of articles in said side panel of said flexible bag after the first stack of articles has been removed.

9. The flexible bag of claim 3, wherein said line of weakness is comprised of perforations in the material comprising said bag.

10. The flexible bag of claim 9, wherein at least a portion of said line of weakness is comprised of laterally extending perforations to minimize the need for precise registration of said lines of perforation in said vertically extending portions of said front and back panels with one another in the closed uppermost end of said bag.

11. The flexible bag of claim 3, including graphical indicia to direct the user's attention to the portion of said line of weakness extending into said closed uppermost end of said bag.

12. An easy open substantially rectangular flexible bag of compressed flexible articles, said flexible articles being arranged in a stack and held in compression in a direction substantially parallel to their thickness, said bag of articles comprising:

(a) a flexible bag having a front and a back panel connected to one another by means of a pair of side panels, a bottom panel secured about its periphery to said front and back and side panels and a closed uppermost end comprising a pair of inwardly folded side gussets secured between the vertically extending portions of said front and back panels by means of at least one horizontal area of securement;

(b) a stack of articles contained within said flexible bag, said articles being oriented so that the substantially planar surface of said articles is aligned substantially parallel to the side panels of said bag and the outermost peripheral edges of the articles contained within said stack are aligned substantially parallel to the front and back panels of said bag, said articles being compressed in a direction substantially parallel to their thickness so that said front and back panels and said side panels of said flexible bag are subject to tension; and (c) an easy open device comprising a substantially continuous line of weakness located partially within one of said tensioned side panels of said bag and extending into said closed uppermost end of said bag near an innermost end of one of said opposed, inwardly folded side gussets, whereby said easy open bag can be easily opened by at least partially separating a corner portion of said bag from the remainder of said bag by applying tension along said continuous line of weakness, said separation also removing said included portion of said side gusset of said bag from the closed uppermost end of said bag during the separation process, whereupon the portion of the stack of compressed articles coinciding with the aperture created in said tensioned side panel projects through said aperture in a fan-like array to facilitate easy one-at-a-time removal of said articles from said bag.

13. An easy open substantially rectangular flexible bag of compressed flexible articles, said flexible articles being arranged in a stack and held in compression in a direction substantially parallel to their thickness, said bag of articles comprising:

(a) a flexible bag having a front and a back panel connected to one another by means of a pair of side panels, a bottom panel secured about its periphery to said front and back and side panels and a closed uppermost end comprising a pair of inwardly folded side gussets secured between the vertically extending portions of said front and back panels by means of at least one horizontal area of securement;

(b) a stack of articles contained within said flexible bag, said articles being oriented so that the substantially planar surface of said articles is aligned substantially parallel to the side panels of said bag and the outermost peripheral edges of the articles contained within said stack are aligned substantially parallel to the front and back panels of said bag, said articles being compressed in a direction substantially parallel to their thickness so that said front and back panels and said side panels of said flexible bag are subject to tension; and (c) an easy open device comprising a substantially continuous line of weakness located partially within one of said tensioned side panels of said bag and extending into said closed uppermost end of said bag inboard of said opposed, inwardly folded side gussets, whereby said easy open bag can be easily opened by at least partially separating a corner portion of said bag from the remainder of said bag by applying tension along said continuous line of weakness, said separation also removing said included side gusset portion of said bag from the closed uppermost end of said bag during the separation process, whereupon the portion of the stack of compressed articles coinciding with the aperture created in said tensioned side panel projects through said aperture in a fan-like array to facilitate easy one-at-a-time removal of said articles from said bag.

14. The flexible bag of compressed articles of claim 12 or claim 13, wherein a pair of horizontal areas of securement are provided in the uppermost end of said bag, said horizontal areas of securement being separated from one another by a predetermined distance, said bag further including means for carrying said bag provided in the area located intermediate said horizontal areas of securement.

15. The flexible bag of claim 14, wherein said means for carrying said bag comprises a continuous curvilinear slit.

16. The flexible bag of claim 15, wherein said continuous curvilinear slit defines an aperture.

17. The flexible bag of claim 14, wherein said portion of said line of weakness extending into said closed uppermost end of said bag is located between said carrying means and the innermost end of the side gusset located adjacent said side panel containing a portion of said line of weakness.

18. The flexible bag of claim 14, wherein said portion of said line of weakness located in said closed uppermost end of said bag is located between said carrying means and the innermost end of the side gusset located opposite said side panel containing a portion of said line of weakness.

19. The flexible bag of claim 14, wherein at least two superposed stacks of compressed flexible articles are contained within said flexible bag, and wherein said side panel containing a portion of said line of weakness further includes a pair of ancillary lines of weakness to expose a portion of a secondary stack of compressed flexible articles in said side panel of said flexible bag after the first stack of compressed flexible articles has been removed.

20. The flexible bag of claim 14, wherein said line of weakness is comprised of perforations in the material comprising said bag.

21. The flexible bag of claim 20, wherein at least a portion of said line of weakness is comprised of laterally extending perforations to minimize the need for precise registration of said lines of perforation in said vertically extending portions of said front and back panels with one another in the closed uppermost end of said bag.

22. The flexible bag of claim 14, including graphical indicia to direct the user's attention to the portion of said line of weakness extending into said closed uppermost end of said bag.

* * * * *

UNITED STATES PATENT AND TRADEMARK OFFICE

CERTIFICATE OF CORRECTION

PATENT NO. : 4,966,286

DATED : October 30, 1990

INVENTOR(S) : Delmar R. Muckenfuhs

It is certified that error appears in the above-identified patent and that said Letters Patent is hereby corrected as shown below:

Column 6, line 62, after "panels" insert -- 131, 132, --.

Column 7, line 48, delete "laving" and insert therefor -- leaving --.

Column 8, line 18, after "embodiment" insert -- 10 --.

Signed and Sealed this

Twenty-third Day of March, 1993

*Attest:*

STEPHEN G. KUNIN

*Attesting Officer*

*Acting Commissioner of Patents and Trademarks*